US006666428B2

(12) United States Patent
Ward

(10) Patent No.: US 6,666,428 B2
(45) Date of Patent: Dec. 23, 2003

(54) METHOD AND APPARATUS FOR RETAINING SEPARABLE COUPLING PARTS FOR CONCRETE FORMING PANEL

(75) Inventor: Philip T. Ward, Leawood, KS (US)

(73) Assignee: Western Forms, Inc., Kansas City, MO (US)

( * ) Notice: Subject to any disclaimer, the term of this patent is extended or adjusted under 35 U.S.C. 154(b) by 172 days.

(21) Appl. No.: 09/791,399

(22) Filed: Feb. 23, 2001

(65) Prior Publication Data

US 2002/0117597 A1 Aug. 29, 2002

(51) Int. Cl.[7] ..... E04G 9/10; E04G 17/00
(52) U.S. Cl. ..... 249/196; 249/189; 249/210
(58) Field of Search ..... 249/189, 210, 249/219.1, 219.2, 192, 191, 196, 45; 211/89.01, 124, 60.1; 29/897.312, 897.32

(56) References Cited

U.S. PATENT DOCUMENTS

| | | | | | |
|---|---|---|---|---|---|
| 2,151,210 | A | * | 3/1939 | Jennings | 249/189 |
| 2,782,484 | A | * | 2/1957 | De Canio | 249/219.2 |
| 3,603,551 | A | * | 9/1971 | Peterson | 211/89.01 |
| 4,210,305 | A | * | 7/1980 | Williams | 249/191 |
| 4,708,315 | A | | 11/1987 | Carlson et al. | |
| 4,744,541 | A | | 5/1988 | Carlson et al. | |
| 4,958,800 | A | | 9/1990 | Carlson | |
| 4,976,401 | A | | 12/1990 | Carlson | |
| 4,978,099 | A | | 12/1990 | Carlson | |
| 5,058,855 | A | | 10/1991 | Ward | |
| 5,080,321 | A | | 1/1992 | Carlson | |
| 5,160,640 | A | * | 11/1992 | Badstieber | 249/189 |
| 5,174,909 | A | | 12/1992 | Ward | |
| 5,184,439 | A | | 2/1993 | Ward | |
| 5,251,868 | A | * | 10/1993 | Trimmer et al. | 249/196 |
| 5,288,051 | A | | 2/1994 | Ward | |
| 5,965,053 | A | | 10/1999 | Carlson | |

OTHER PUBLICATIONS

Brochure: The World's Leading Innovator in Aluminum Forming Systems (Western Forms, Inc. 1993) (1 page and 1 card enclosure in the back) (6 pages printed on front and back including cover).
Brochure: A New Generation in Aluminum Forming Systems (Western Forms, Inc., 1998) (6 pages printed on front and back including cover).
Brochure: Concrete Forming Accessories, 2nd ed. (Western Forms, Inc.(before1999)) (49 printed pages not including front/back cover, divider tabs and printing on inside of covers).
Western Forms, Inc. Catalog titled "World's Leading Innovator in Aluminum Forming Systems" copyright 1999, all pages.

* cited by examiner

*Primary Examiner*—Michael Safavi
(74) *Attorney, Agent, or Firm*—Hovey Williams LLP

(57) ABSTRACT

A method and apparatus for retaining separable parts for a concrete forming panel includes the provision of a retaining member on the forming panel located separately from any one of a plurality of coupling sites. Separate and discrete parts may be held on the retaining member until the parts are ready for use. The retaining member may include a reinforcing bar having at least one and preferably a plurality of openings therein for frictionally holding the part therein. The opening may be provided with a gripper to enhance the frictional engagement and improve the parts holding ability of the retaining member. The retaining member may include a magnetic coupler which is especially useful with aluminum forms for holding steel parts in position. Further, the retaining member may include a self-sticking material with cooperating components on the part and the form whereby the parts may be readily attached and removed from predetermined areas on the forming panel.

5 Claims, 4 Drawing Sheets

METHOD AND APPARATUS FOR RETAINING SEPARABLE COUPLING PARTS FOR CONCRETE FORMING PANEL

BACKGROUND OF THE INVENTION

1. Field of the Invention

This invention concerns a forming panel including a parts receiver for holding separate, discrete parts which may be used in connection with the forming panel.

2. Description of the Prior Art

Forming panels used in erecting concrete walls for structures are often provided in standard sizes and shapes, and thus must be connected in order to establish a pair of opposed forming walls into which concrete may be poured for hardening into the final structural shape. Thus, adjacent forming panels are coupled together by pins, wedges and other fasteners, and opposing walls are connected by tie bars and the like. The purpose of such forms is that they may be removed and reused after the concrete is hardened. However, keeping track of the large number of pins, wedges, nuts and other connectors has been a problem. One other problem associated with such small parts is that they are often not readily available to the workman who must assemble the forms. Thus, parts may be lost or displaced, located in a remote area on the jobsite, or otherwise separated from the forming panel. Certain parts are relatively specialized and thus somewhat expensive to replace, and are repeatedly used with the same forming panel. Moreover, several workman must often wait while the parts are obtained by another workman, resulting in the loss of productive time of not merely one but several workers. Thus, the expensive of replacement parts and the time lost in locating and retrieving such small parts is an economic loss as well as an aggravation to the construction crew.

While the forming panels include a plurality of coupling sites which are normally adapted to receive some or all of the parts for use in, for example, attaching the forming panel to a complementally configured forming member, it is unsatisfactory to carry the separate parts in these locations during transit and storage. Typically, these "in use" positions are exposed, and placing the parts in these coupling sites subjects the parts, and more importantly the forms themselves which are often of a softer material, to substantial use and wear as the parts are impacted. Moreover, holding the parts in such "in use" positions interferes with handling and positioning the forms for coupling as well as storage. In addition, such "in use" positions in the coupling sites subjects the parts themselves to impact and loosening at the site, whereby parts may be readily separated and lost.

One attempt to ameliorate this problem has been to attach small parts by wires to the forming panel. This helps to keep certain parts constant associated with a single form. However, the wire connecting the parts to the form may become entangled with other equipment resulting in a potential safety hazard. In addition, when two or more such small parts are used at a single location, the positioning of the wires may be cumbersome. Also, not all parts will be coupled to a form, or certain special applications may require different small parts to couple the forms together.

There has thus developed a need for improved methods of coupling small parts to concrete forming panels, and in particular aluminum forming panels of a lightweight type of construction.

SUMMARY OF THE INVENTION

These problems have largely been solved by the method and apparatus for retaining separable coupling parts for a concrete forming panel in accordance with the present invention. That is to say, the method and apparatus hereof solves the problem of holding separate and discrete parts on a forming panel at a location spaced from their eventual position for use. By having a parts receiver as a part of the form itself, the parts are releasably held but remain available for use. Moreover, by having the parts receiver spaced from the coupling sites, the parts may be held by the parts receiver during handling and alignment of adjacent forms, so that the parts do not interfere with such alignment but may be quickly transferred to the coupling sites when desired.

Broadly speaking, the forming panel of the present invention includes a face sheet for receiving concrete thereagainst, a frame for supporting the face sheet, and a parts receiver for temporarily holding one or a plurality of separate and discrete parts. By "separate", it is meant that the parts are not held by a wire or other permanent attachment to the forming panel, but rather are completely separable therefrom so that parts may be readily transferred between different forming panels as desired for specific applications. The parts receiver may be provided with openings therein whereby the parts may be frictionally engaged by the parts receiver. In addition, one or more of the openings may be provided with a gripper of an elasotmeric material which increases the frictional engagement between the parts receiver and the part. Because the parts may be configured differently, different shapes of openings may be provided for holding parts of different shapes. For example, some openings may be substantially rectangular or elongated, suitable for holding complementally shaped parts such as wedges, while other openings may be substantially circular for holding, for example, round-shank pins therein. The parts receiver may be provided with a magnetic coupler which is especially beneficial for holding parts of iron or steel when the forming panel frame and face are primarily constructed of aluminum. Thus, the provision of a magnetic coupler helps to hold selected parts, without causing any substantial interference between one form and another. Further, the parts receiver may be provided with a self-sticking material such as grip and loop fabric material, one of the grip and loop fabric being provided on the part while the other of the grip and loop fabric material is provided on the forming panel. Parts may thereby be quickly attached and removed for use. The parts receiver may also be configured and positioned in such a way as to provide stiffening and reinforcement to the frame and or face sheet of the forming panel.

The method of the present invention includes providing a concrete forming panel and at least one part adapted for use therewith, the part being discrete and separate from the forming panel. The forming panel so provided includes a plurality of coupling sites adapted for coupling said panel to a complementally configured forming member which may be positioned adjacent thereto, the forming panel including a parts receiver positioned on said forming panel remote from said coupling sites. The parts are then releasably attached to parts receiver and may thereafter be subsequently moved into the coupling sites during coupling of the forming panel to the adjacent forming member. As a result, no separate box or container need be maintained for the parts during transport and storage, but the parts carried by the parts receivers of different forming panels may be readily interchanged or moved as needed.

These and other advantages will be readily apparent to those skilled in the art with reference to the drawings and description which follow.

DESCRIPTION OF THE PREFERRED EMBODIMENT

Figure 1:
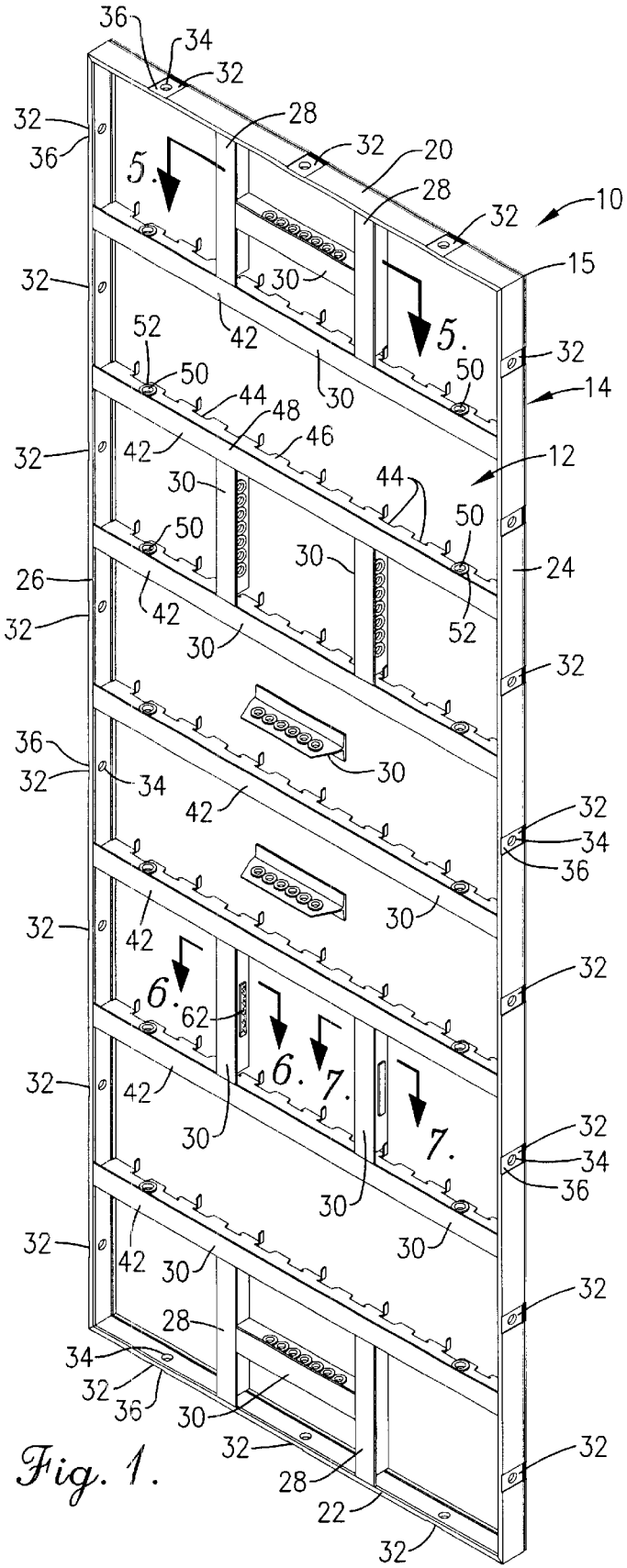
FIG. 1 is a rear perspective view of a forming panel having a face sheet, a frame, and a plurality of parts receivers for receiving discrete parts.

Referring now to the drawing, a forming panel 10 for receiving flowable concrete thereagainst and providing a form for hardening the concrete to a desired shape is generally shown in FIG. 1 and includes a face sheet 12 and a frame 14. The face sheet and frame are provided preferably primarily of aluminum, to include alloys thereof such as ASTM 6061-T6. The face sheet 12 is relatively thin, for example about 0.090 to 0.125 for lightweight applications but may be made thicker for heavier duty applications, and may be substantially flat or textured to provide a brickface or other texture to the concrete hardening thereagainst. The face sheet 12 includes a perimeter 15, a front side 16 and a back side 18, and is welded to the frame 14. The frame 14 has at least one rail of a thickness typically varying between 0.125" and ⅜" for lightweight applications, with thicker aluminum stock provided for larger sizes and heavier duty applications if desired. The frame 14 may be round, oval, polygonal or any other shape as desired, but it is most common to provide a frame 14 having a generally rectangular shape with a pair of parallel, spaced-apart end rails 20 and 22 and a pair of parallel, spaced-apart side rails 24 and 26 which are welded together to provide the support and shape desired for the face sheet 12 as shown in FIG. 1. Stiffeners 28 may be provided as a part of the frame 14 and located on the back side of the face sheet 12. In addition, the present invention includes at least one parts receiver 30. Some of the rails, such as side rails 24 and 26, have coupling sites 32. As shown in FIG. 1, the coupling sites 32 typically include a hole 34 and a relieved area 36. The holes 34 may receive a part 37, such as a pin 38 therein, which can be held by a wedge 40 to couple the forming panel to an adjacent forming structure, such as another panel, corner member, or the like. The relieved areas may have tie-bars placed therealong to connect the forming panels 10 to opposite forming structures.

The parts receiver 30 of the present invention may be provided in different configurations. One example of such a parts receiver 30 is a cross-member 42 extending between the side rails 24 and 26 that includes a plurality of elongated openings 44 in a first bar 46 extending generally perpendicular to the face sheet 12 and further supported and reinforced by a second bar 48 In addition, a plurality of circular openings 50 are provided in the first bar 46 of the cross-member 32. Either or both of the openings 44 and 50 may be provided with grippers 52 inserted therein which are formed of an elastomeric material such as natural or synthetic rubber and which enhance the frictional engagement between the parts receiver and the part held therein. It maybe appreciated that among the parts which may be readily held by the elongated openings 44 are the wedges 40 and that, for example, either the pins 38 or the wedges 40 may be held in the circular openings 50. Furthermore, it may be appreciated that the cross-member 42 serves not only as a parts receiver but also acts as a stiffener for the frame 12.

Figure 2:
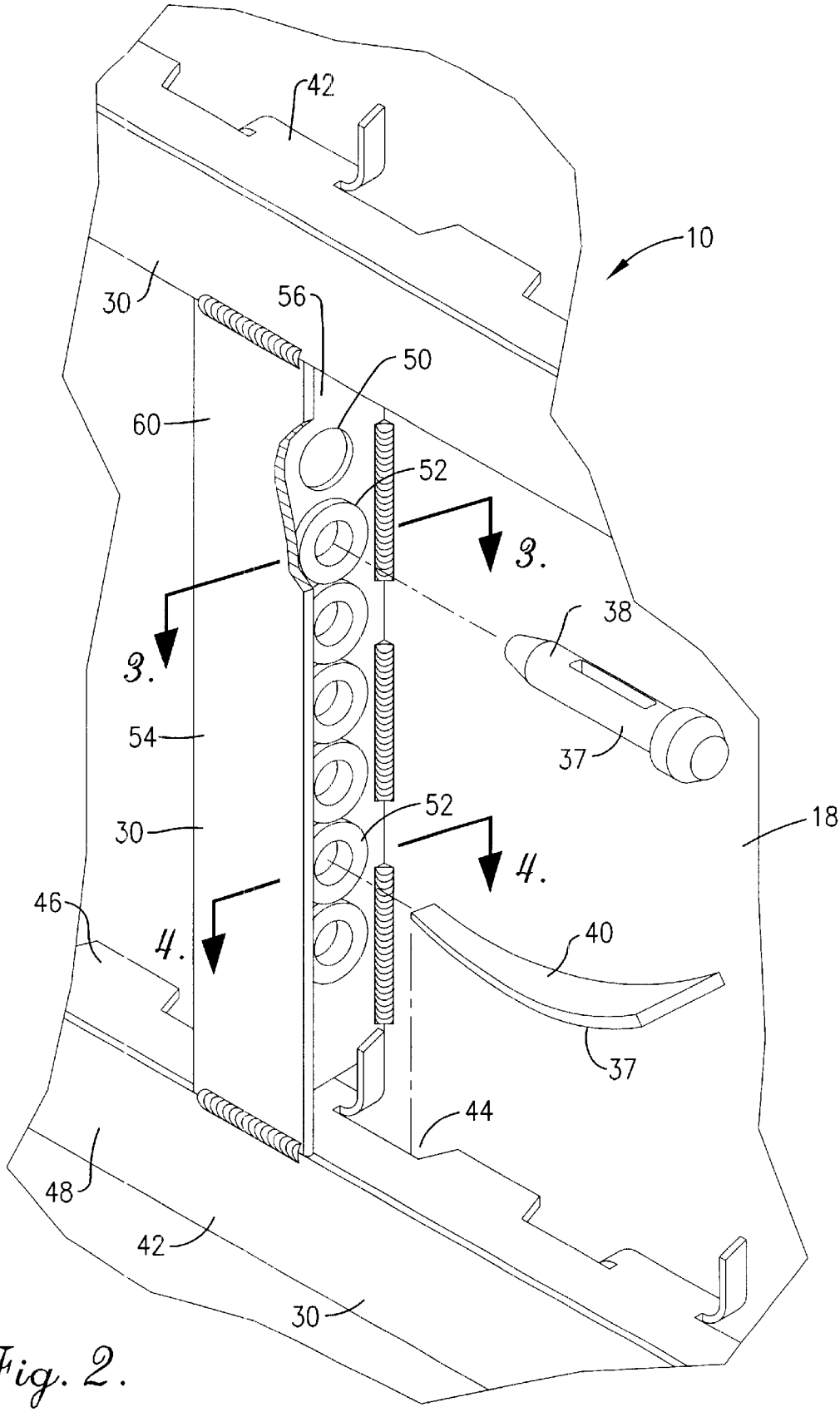
FIG. 2 is a fragmentary enlarged rear perspective view of the forming panel hereof showing a parts receiver having a plurality of circular openings extending between two parts receivers having a plurality of elongated openings and two parts positioned for receipt by one of the parts receivers.
Figure 3:
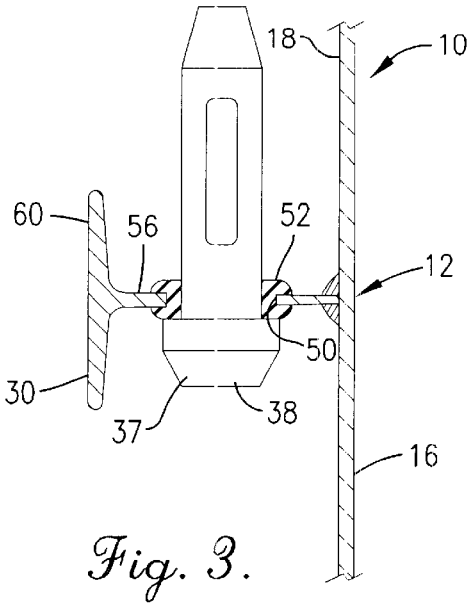
FIG. 3 is an enlarged horizontal cross-sectional view taken along line 3—3 of FIG. 2 showing a pin received in a gripper placed in an opening of a parts receiver.
Figure 4:
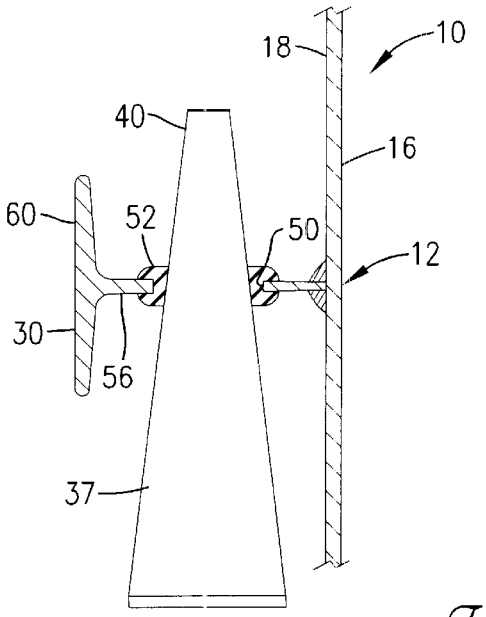
FIG. 4 is an enlarged horizontal cross-sectional view taken along line 4—4 of FIG. 2 showing a wedge received in a gripper placed in an opening of a parts receiver.
Figure 5:
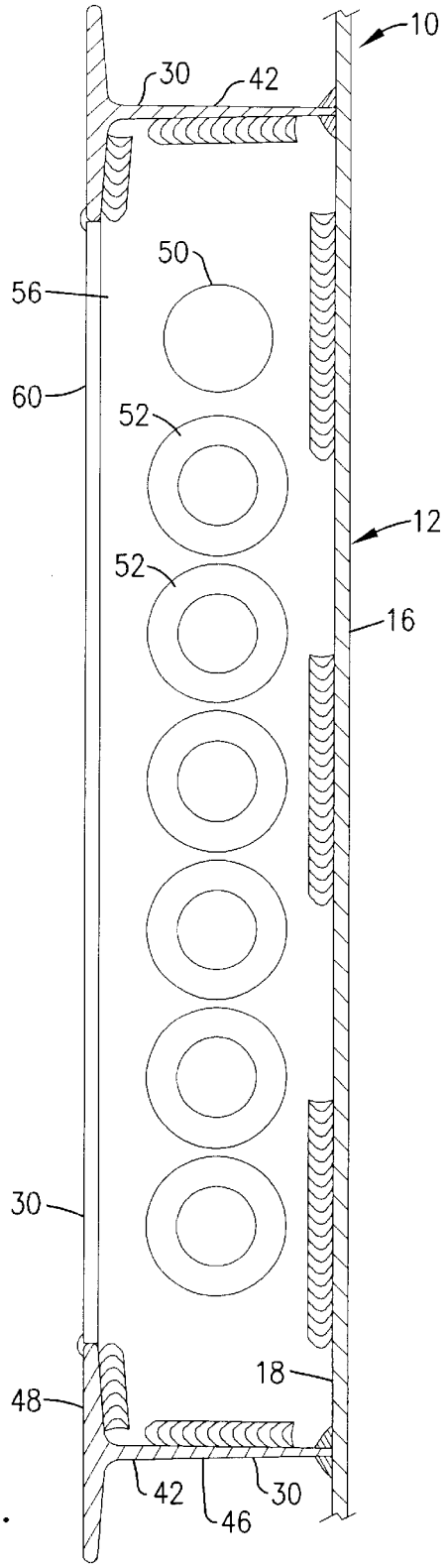
FIG. 5 is an enlarged horizontal cross-sectional view taken along line 5—5 of FIG. 1 showing a parts receiver having a plurality of holes and spanning between two other parts receivers in reinforcing relationship thereto.

Another type of parts receiver 30 useful in the present invention is a brace 54 as shown in FIGS. 1–5. The brace 54 as shown has a first wall 56 extending generally perpendicular to the face sheet 12 which includes openings 50 therein, and a second wall 60 oriented generally parallel to the face sheet 12. The openings 50 are shown as circular, but may be elongated or of other shapes to receive desired parts in complemental interfitting relationship. As shown in FIGS. 1–5, some or all of the openings 50 may be provided with grippers 52, which frictionally engage the parts. The brace 54 may be positioned between and welded to cross-members 42 as shown in FIG. 2 to provide both structural reinforcement to the frame 14, stiffness to the face sheet 12, and a retaining member for the parts. It can also be positioned between adjacent stiffeners 28 as shown in FIGS. 1 and 5. In these configurations, the second wall 60 serves to both reinforce the first wall 56 and to protect the parts received therein against unintended impact which may cause them to loosen and fall. In another configuration as shown in FIG. 1, the brace 54 can be placed with the second wall 60 against the back side of the face sheet 12 for ease of access to parts placed therein.

Figure 6:
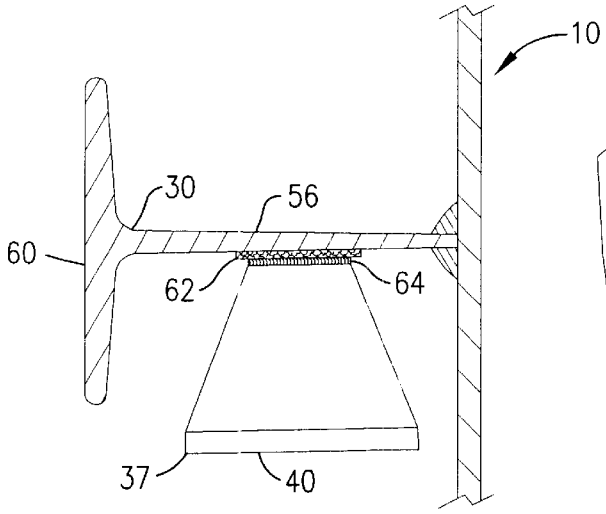
FIG. 6 is an enlarged horizontal cross-sectional view taken along line 6—6 of FIG. 1 showing a parts retainer having a grip and loop fabric material for temporarily and releasably holding a part thereto.

FIG. 6 shows a parts receiver 30 used in connection with the forming panel 10 which includes a strip 62 of one of hook and loop type material and another strip 64 of the other of the hook and loop type material attached to a part 37 such as a wedge 40. Such strips 62 may be attached to either the first bar 46 or the second bar 48 preferably by adhesive, or alternatively by a mechanical fastener. One example of a hook and loop type material useful for the strips is sold by McMaster-Carr of Chicago, Ill. as mushroom grip and loop fabric, the mushroom grip material being of woven polypropylene with a polyester base as part number 94975K62, and the loop fabric provided as a knit nylon base with nylon napped loops as part number 94975K72. It may be appreciated that other types of hook and loop material may also be used for the strips, and that the hook or mushroom material may be applied to either the part or the parts receiver and the loop material would then be used with the other of the part and parts receiver.

Figure 7:
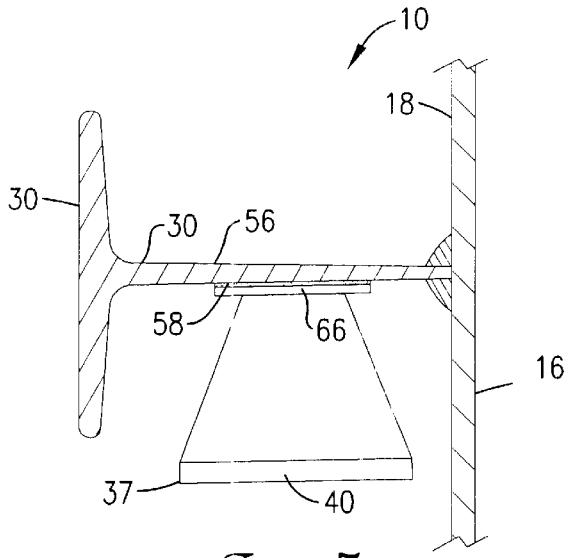
FIG. 7 is an enlarged horizontal cross-sectional view taken along line 7—7 of FIG. 1 showing a parts retainer having a magnet section for temporarily and releasably holding a part thereto.

FIG. 7 shows a parts receiver 30 used in connection with the forming panel 10 which includes a strip 66 of magnetic material. The strip 66 may be of magnetized metal such as iron, nickel or cobalt or alloys thereof, or ceramic magnets, or alternatively flexible magnetic material, and adhesive 58, welding or the like may be used to attach the strip 66 of magnetic material to the parts receiver 30. The parts 37 are typically of steel which permits easy magnetic releasable coupling of the part, such as wedge 40, to the strip 66 on the parts receiver 30. In addition, the grippers 52 may be of a magnetic material to further enhance retention of the parts 37 placed into an opening. Furthermore, the entire parts receiver 30 may be provided entirely of a magnetic material if desired.

Figure 8:
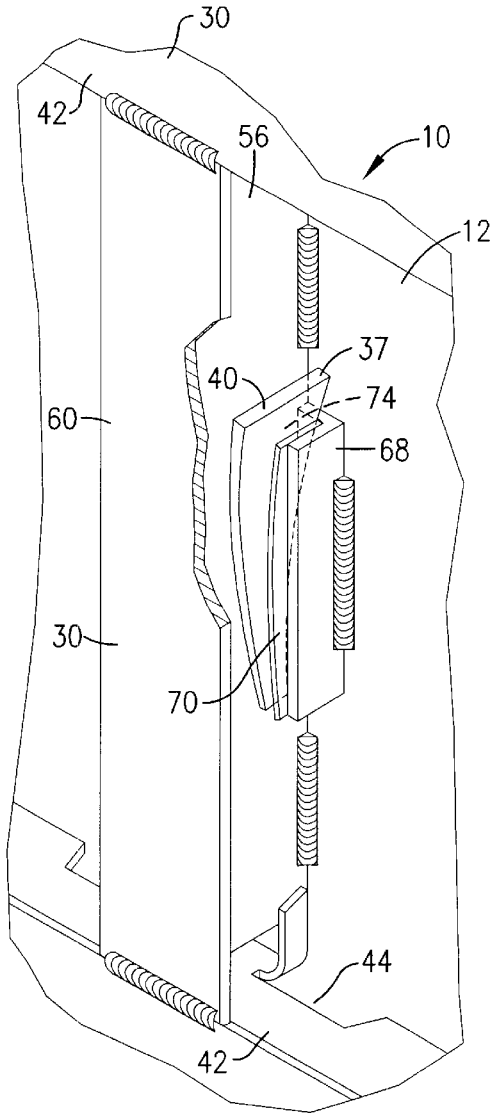
FIG. 8 is a fragmentary enlarged rear perspective view of an alternate embodiment of the forming panel hereof showing a parts receiver having a wing to which a flexible strip is attached for gripping a part.

FIG. 8 shows an alternate embodiment of the forming panel 10 with a parts receiver 30 wherein a flange 68 is provided on the first bar 56 which holds, by friction, a mechanical fastener, adhesive bonding or the like, a flexible gripper 70 to hold the parts 37. The flexible gripper 70 is shown as a strip 72 of steel bonded to the flange 68, but it may be appreciated that natural or synthetic rubber, aluminum or the like may be bonded to the parts receiver 30 and used for the strip 72. The part 37, such as wedge 40, may be tucked into the opening 74 behind the strip 72 which is opposed to the first bar 36, and thus held between the strip 72 and the first bar 36.

The forming panel 10 with the parts receiver 30 is especially convenient in use. The parts 37 may be temporarily stored in a complementally configured location on the parts receiver 30, and as shown in FIGS. 3 and 4, differently shaped parts may be stored on the parts receiver 30 in different locations. For example, when a pin 38 or wedge 40 is to be stored, either may be placed in a circular opening 50. Alternatively, wedges 40 may be releasably held by the elongated openings 48 and the pins 38 may be held by the circular openings 50. More than one shape of opening may be provided, such that, for example, a cross-member 42 may include both elongated openings 48 and circular openings 50. The forming panel 10 may include only one type of parts receiver, or several as illustrated in FIG. 1. The parts receivers 30 are all positioned relatively remotely from the coupling sites so as not to interfere with storage and assembly of the forming panels 10 into a composite forming wall of several forming panels and associated forming structures. However, they are located on the forming panel so as to be readily accessible for use, such that when two such forming panels 10 are to be coupled together, it is easy to retrieve a pin 38, place it into the holes in the adjacent forming panels, and insert the wedge 40 into the slot in the pin to couple the forms together. After use, the parts 37 may be returned to the parts receiver until needed for the next job. The provision of the grippers is useful for improving the frictional engagement between the parts receiver 30 and the parts 37, thus inhibiting loosening of the parts 37 placed therein but still permitting them to be readily separated from use. Because the parts 37 are completely separate, a variety of differently configured parts may be held by a single forming panel 10, and may be moved to different forming panels 10 as the need arises.

It is to be appreciated that the shapes of the openings and parts shown and described are illustrative only, and that a variety of different parts may be used with the forming panel.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of their invention as pertains to any apparatus not materially departing from but outside the literal scope of the invention as set out in the following claims.

What is claimed is:

1. A concrete forming panel comprising:

a face sheet having a perimeter, a back side, and a front side for receiving concrete thereagainst;

a frame coupled to and supporting the face sheet proximate the perimeter thereof, said frame including a plurality of coupling sites; and at least one parts receiver positioned remotely from said coupling sites and adapted for releasably holding separate and discrete parts, said frame including outer members at the perimeter of the face sheet that project rearwardly away from said back side of the face sheet to a certain extent to present rearmost surfaces that define a rearmost extremity of the panel, said outer frame members and said face sheet serving to define a parts holding region on the back side of the face sheet haying lateral boundaries located at said outer frame members, a front boundary located at said face sheet, and an imaginary rear boundary located at said rearmost extremity of the panel, said parts receiver having at least one opening therein and a gripper of flexible material within said opening, said parts receiver being disposed wholly within said region, and said opening being spaced from said outer frame members and oriented in such a direction that when a part is gripped in said opening by said gripper, the part is contained wholly within said region and does not project outwardly beyond said boundaries thereof, said parts receiver being elongated and including a pair of rigid walls intersecting one another at generally right angles, a first of said walls intersecting a second of said walls intermediate opposite ends of the second wall to render the parts receiver generally T-shaped in transverse cross-sectional configuration, said holes being located in said first wall.

2. A concrete forming panel as set forth in claim 1, wherein said gripper is of an elastomeric rubber.

3. A concrete forming panel as set forth in claim 1, said parts receiver being secured to said face plate in such a manner that said second wall abuts against the back side of the face plate and said first wall projects rearwardly away from the face plate.

4. A concrete forming panel as set forth in claim 1, said parts receiver being secured to said face plate in such a manner that said first wall projects edge-wise rearwardly from the back side of said face plate and said second wall extends generally parallel to the face plate in rearwardly spaced relationship therewith.

5. A concrete forming panel as set forth in claim 1, wherein said opening is circular.

* * * * *